US005413064A

United States Patent [19]

Paraskevopoulos

[11] Patent Number: 5,413,064

[45] Date of Patent: May 9, 1995

[54] BOAT HAVING AN ELEVATED AND AFT LOCATED CON POSITION

[76] Inventor: Leo Paraskevopoulos, 12/2 Charnwood Street, St. Kilda 3182, Australia

[21] Appl. No.: 107,679

[22] PCT Filed: Dec. 17, 1991

[86] PCT No.: PCT/AU91/00584

§ 371 Date: Aug. 16, 1993

§ 102(e) Date: Aug. 16, 1993

[87] PCT Pub. No.: WO90/11180

PCT Pub. Date: Jul. 9, 1990

[30] Foreign Application Priority Data

Dec. 18, 1990 [AU] Australia ..... PK3934

[51] Int. Cl.[6] ..... B63B 17/00

[52] U.S. Cl. ..... 114/255

[58] Field of Search ..... 114/255, 343, 65 R, 114/71

[56] References Cited

U.S. PATENT DOCUMENTS

| | | | |
|---|---|---|---|
| 3,797,432 | 3/1974 | Mermudez | 114/255 |
| 4,354,447 | 10/1982 | Hultgren | 114/255 |
| 4,442,786 | 4/1984 | Conners | 114/255 |
| 4,732,103 | 3/1988 | Culbertson | 114/71 |

FOREIGN PATENT DOCUMENTS

| | | |
|---|---|---|
| 6069580 | 1/1981 | Australia . |
| 57-130883 | 8/1982 | Japan . |
| 62-139785 | 6/1987 | Japan . |
| 56-5288 | 1/1988 | Japan . |

*Primary Examiner*—Stephen P. Avila
*Attorney, Agent, or Firm*—Thomas R. Vigil

[57] ABSTRACT

A boat having a tower (3) extending upwardly and supporting a con position (7) adjacent the upper end thereof and wherein the con position (7) has a sole (8) having an aft end located not more than 10% of the load waterline length of the boat forward of a stern of the boat.

9 Claims, 2 Drawing Sheets

BOAT HAVING AN ELEVATED AND AFT LOCATED CON POSITION

This invention relates to boats.

The present inventor has noted that many powered fishing boats are provided with a tower having a con position located adjacent the top of the tower from which the movement of the boat in the water can be controlled. The principal reason for such towers is to allow a person conning the boat to have better visibility of the water for purposes including mooring, avoiding obstacles and for the sighting of fish.

However, the inventor has noted that such towers are always located substantially centrally of the load waterline of the boat and has further noted that such a location has a restricted view downwardly into the water as the bow and stern of the boat obscure the view and, further, such view as there is tends to be oblique in substantial part such that light reflected of an oblique water surface obscures the view.

Since viewing substantially directly down into the water is important in some types of fishing, particularly marlin fishing, the present inventor considers that existing towers are not satisfactory.

Accordingly, the present invention provides a boat having a tower extending upwardly and supporting a con position adjacent the upper end thereof and wherein the con position has a sole having an aft end located not more than 10% of the load waterline length of the boat forward of a stern of the boat.

Preferably said aft end is located not more than 10% of the load waterline length forward or aft of the stern.

More preferably said aft end is located substantially directly above the stern.

Preferably said tower extends upwardly and aftwards. The aftwards extending of the tower effectively can locate the centre of gravity of the tower further forward than if the tower extended vertically.

Preferably said sole is located not lower than 25% of the load waterline length of the boat above the load waterline of the boat.

More preferably said sole is located not lower than 33% of the load waterline length of the boat above the load waterline of the boat.

Most preferably said sole is located between 25% to 66% of the load waterline length of the boat above the load waterline of the boat.

The tower preferably comprises upwardly and aftwardly extending limbs which extend from positions relatively lateral of the boat. Those limbs are preferably joined at the top thereof to stabilise the tower.

Ladder means may be provided on one or more of the limbs.

The present invention will now be illustrated by way of non-limiting example with reference to the accompanying drawings in which.

Figure 1:
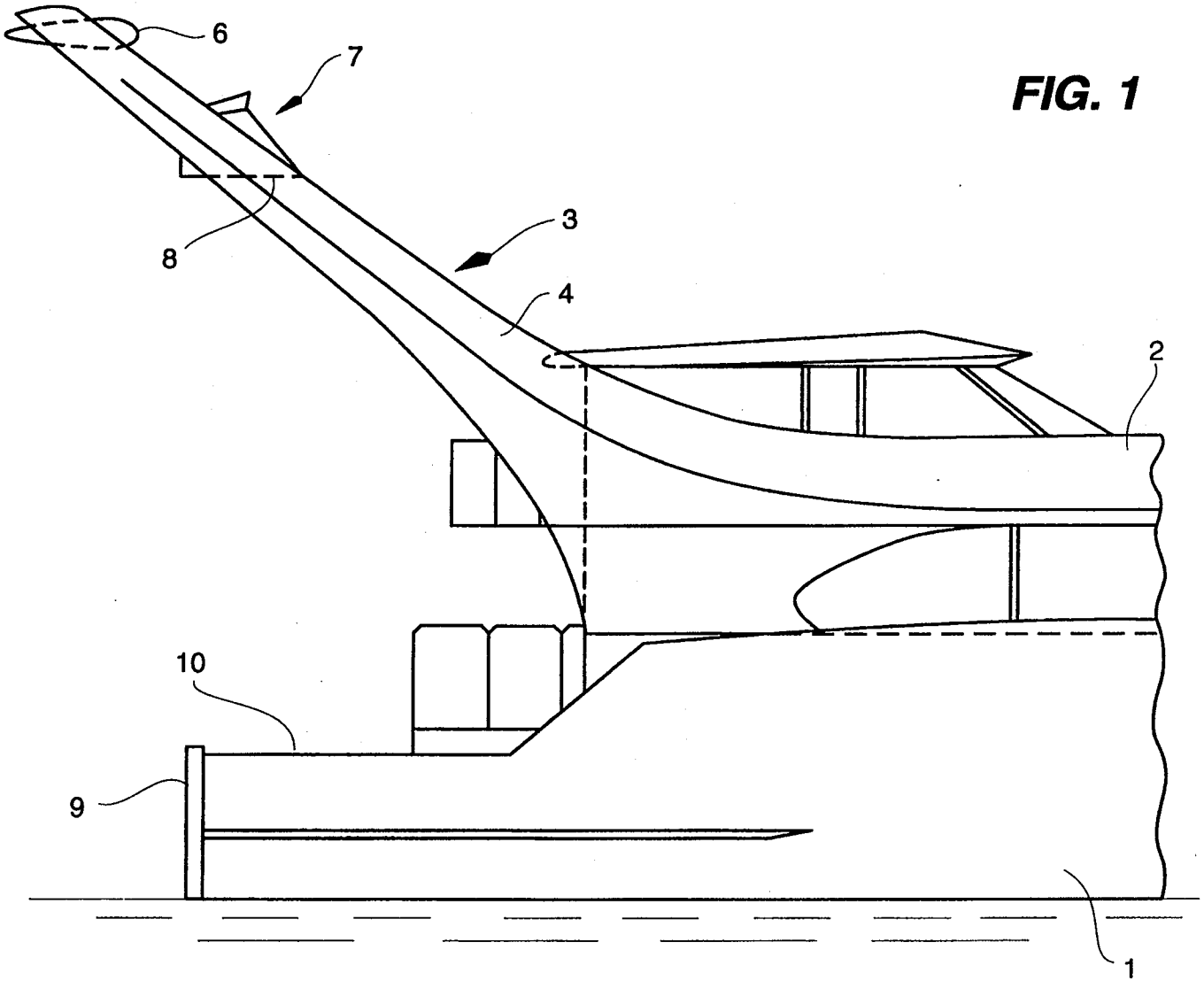
FIG. 1 is a side elevational view of the aft end of a boat constructed in accordance with this invention.

The boat shown in FIG. 1 has a hull 1, a superstructure 2 which encloses controls for the boat and a tower 3.

The tower 3 comprises two limbs 4, a wing 6 joining the limbs 4 and a con position 7.

A ladder (not shown) will normally be located on one or both of the limbs 4.

The con position 7 comprises a sole 8 and also comprises such controls for the boat as are considered necessary.

It is to be noted that the sole 8 at its aft end is directly above the stern 9 of the boat.

The above described con position allows a good view of the boat itself and of any adjacent wharf or obstacle but also enables a good view substantially directly down into the water whilst leaving the fishing cockpit area 10 unobstructed.

Figure 2:
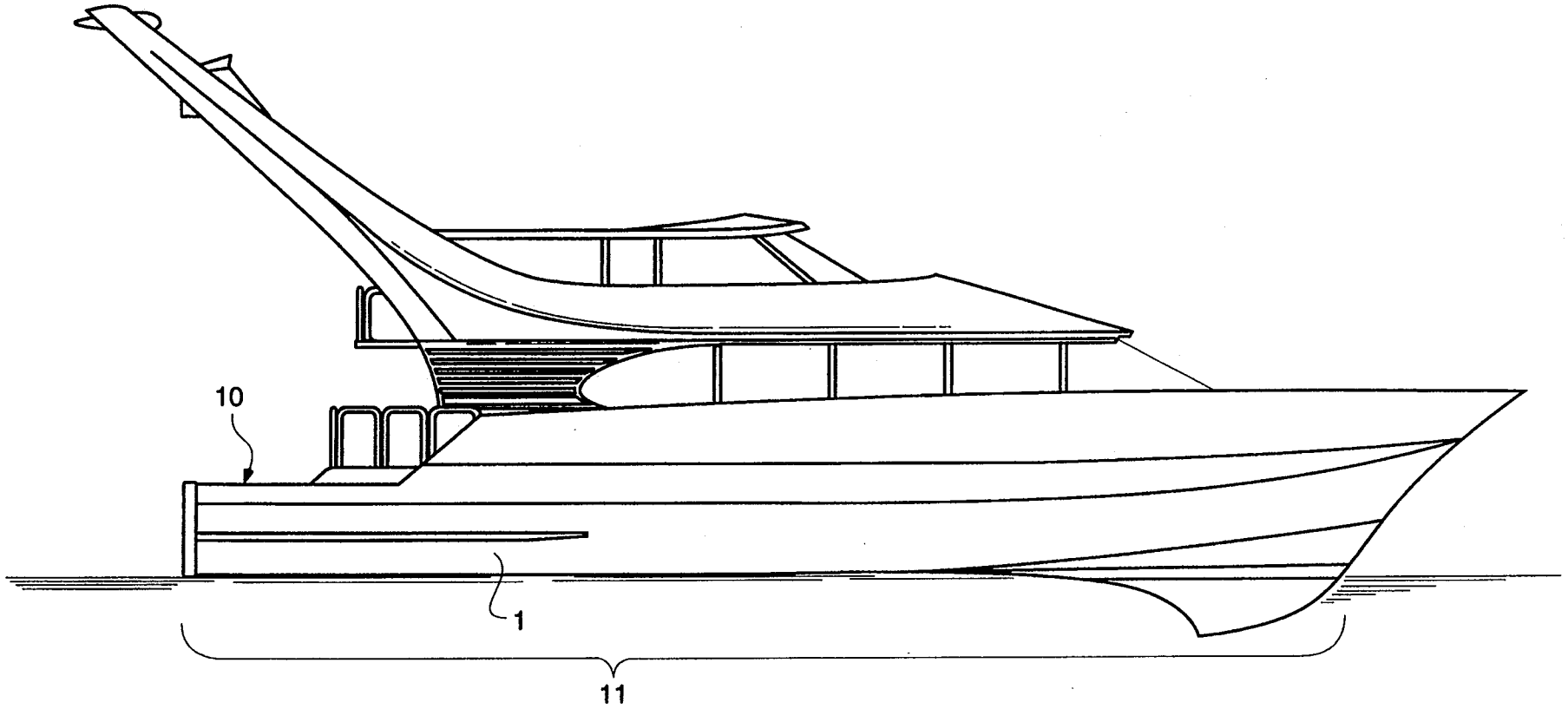
FIG. 2 is a side elevational view of a full boat constructed in accordance with this invention showing the load water line length of the boat.

Referring to FIG. 2, the load water line length of the boat is shown by the line extending along the length of the boat at water level and designated by the reference numeral 11.

The described arrangement has been advanced merely by way of explanation and many modifications may be made thereto without departing from the spirit and scope of the invention which includes every novel feature and combination of novel features herein disclosed.

I claim:

1. A fishing, sport or pleasure boat having a fishing cockpit area and a tower supporting a wing tower control position provided with controls for maneuvering the boat, adjacent the upper end thereof, the wing tower control position having a sole with an aft end located not more than 10% of the load water line length of the boat forward of a stern of the boat the sole being located not lower than 25% of the load water line length of the boat above the load water line of the boat, the construction of the tower being such as to leave the fishing cockpit area unobstructed and to allow an unobstructed view from the wing tower control position directly down into the water behind the stern.

2. A boat as claimed in claim 1, wherein said aft end is located not more than 10% of the load water line length forward or aft of the stern.

3. A boat as claimed in claim 1, wherein said aft end is located substantially directly above the stern.

4. A boat as claimed in claim 1, wherein said tower extends upwardly and aftwards.

5. A boat as claimed in claim 1, wherein said sole is located not lower than 33% of the load water line length of the boat above the load water line of the boat.

6. A boat as claimed in claim 1, wherein said sole is located between 25% to 66% of the load water line length of the boat above the load water line of the boat.

7. A boat as claimed in claim 1, wherein the tower comprises upwardly and aftwardly extending limbs which extend from positions relatively lateral of the boat.

8. A boat as claimed in claim 1, wherein the limbs are joined at the top thereof to stabilize the tower.

9. A boat as claimed in claim 1, including ladder means on one or more of the limbs.

* * * * *